US008280094B2

(12) United States Patent
Lehdorfer et al.

(10) Patent No.: US 8,280,094 B2
(45) Date of Patent: Oct. 2, 2012

(54) IN-EAR EARPHONE

(75) Inventors: Hannes Lehdorfer, Vienna (AT); Berthold Pavitsich, Müllendorf (AT); Bernhard Pinter, Moosbrunn (AT)

(73) Assignee: AKG Acoustics GmbH, Vienna (AT)

( * ) Notice: Subject to any disclaimer, the term of this patent is extended or adjusted under 35 U.S.C. 154(b) by 269 days.

(21) Appl. No.: 12/872,597

(22) Filed: Aug. 31, 2010

(65) Prior Publication Data

US 2011/0051981 A1 Mar. 3, 2011

(30) Foreign Application Priority Data

Sep. 3, 2009 (EP) ..... 09450156

(51) Int. Cl.
*H04R 25/00* (2006.01)

(52) U.S. Cl. ..... 381/380; 381/328; 381/370

(58) Field of Classification Search ..... 381/312, 381/328, 370, 373, 374, 376, 380; 379/430; 181/128, 129, 130, 135
See application file for complete search history.

(56) References Cited

U.S. PATENT DOCUMENTS

| | | | | |
|---|---|---|---|---|
| 4,972,488 | A | 11/1990 | Weiss et al. | |
| 5,737,436 | A | 4/1998 | Boyden | |
| 5,909,498 | A * | 6/1999 | Smith | 381/380 |
| 2006/0045284 | A1 * | 3/2006 | Haussmann et al. | 381/72 |
| 2006/0133630 | A1 | 6/2006 | Harvey | |
| 2006/0133631 | A1 | 6/2006 | Harvey | |
| 2008/0013774 | A1 * | 1/2008 | Hosaka et al. | 381/380 |
| 2009/0232341 | A1 | 9/2009 | Pinter et al. | |

FOREIGN PATENT DOCUMENTS

| | | | |
|---|---|---|---|
| EP | 2 101 512 | A1 | 9/2009 |
| WO | WO 97/11574 | A1 | 3/1997 |
| WO | WO 2006/068772 | A2 | 6/2006 |
| WO | WO 2006/083834 | A2 | 8/2006 |

* cited by examiner

*Primary Examiner* — Tuan Nguyen
(74) *Attorney, Agent, or Firm* — Brinks Hofer Gilson & Lione

(57) ABSTRACT

An earphone device converts electric signals to audible sound. The earphone includes a first electroacoustic transducer and a second electroacoustic transducer. A separating part of the earphone is positioned between the second transducer and a sound opening of a plug area of the earphone. The separating part forms a barrier between a first sound path for the first transducer and a second sound path for the second transducer. The first sound path comprises a substantially annular cross-section disposed around the second sound path. The earphone includes a filter disk arranged in the sound opening, in which an acoustic friction is provided for each of the first and second sound paths.

20 Claims, 4 Drawing Sheets

IN-EAR EARPHONE

PRIORITY CLAIM

This application claims the benefit of priority from European Patent Application No. 09450156.6, filed Sep. 3, 2009, which is incorporated by reference.

BACKGROUND

1. Technical Field

This application relates to devices that convert electric signals to audible sound and, more particularly, to earphones with multiple transducers.

2. Related Art

Earphones convert electric signals into audible sound. They may compensate for impaired hearing, deliver music or radio programs, or be used to communicate with others. Some earphones include a single electroacoustic transducer that converts the electric signals into audible sound. Other earphones include multiple electroacoustic transducers. The use of multiple electroacoustic transducers may improve the transmission of different frequencies of the audible sound.

SUMMARY

An earphone device converts electric signals to audible sound. The earphone includes a first electroacoustic transducer and a second electroacoustic transducer. A separating part of the earphone is positioned between the second transducer and a sound opening of a plug area of the earphone. The separating part forms a barrier between a first sound path for the first transducer and a second sound path for the second transducer. The first sound path comprises a substantially annular cross-section disposed around the second sound path. The earphone includes a filter disk arranged in the sound opening, in which an acoustic friction is provided for each of the first and second sound paths.

Other systems, methods, features, and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
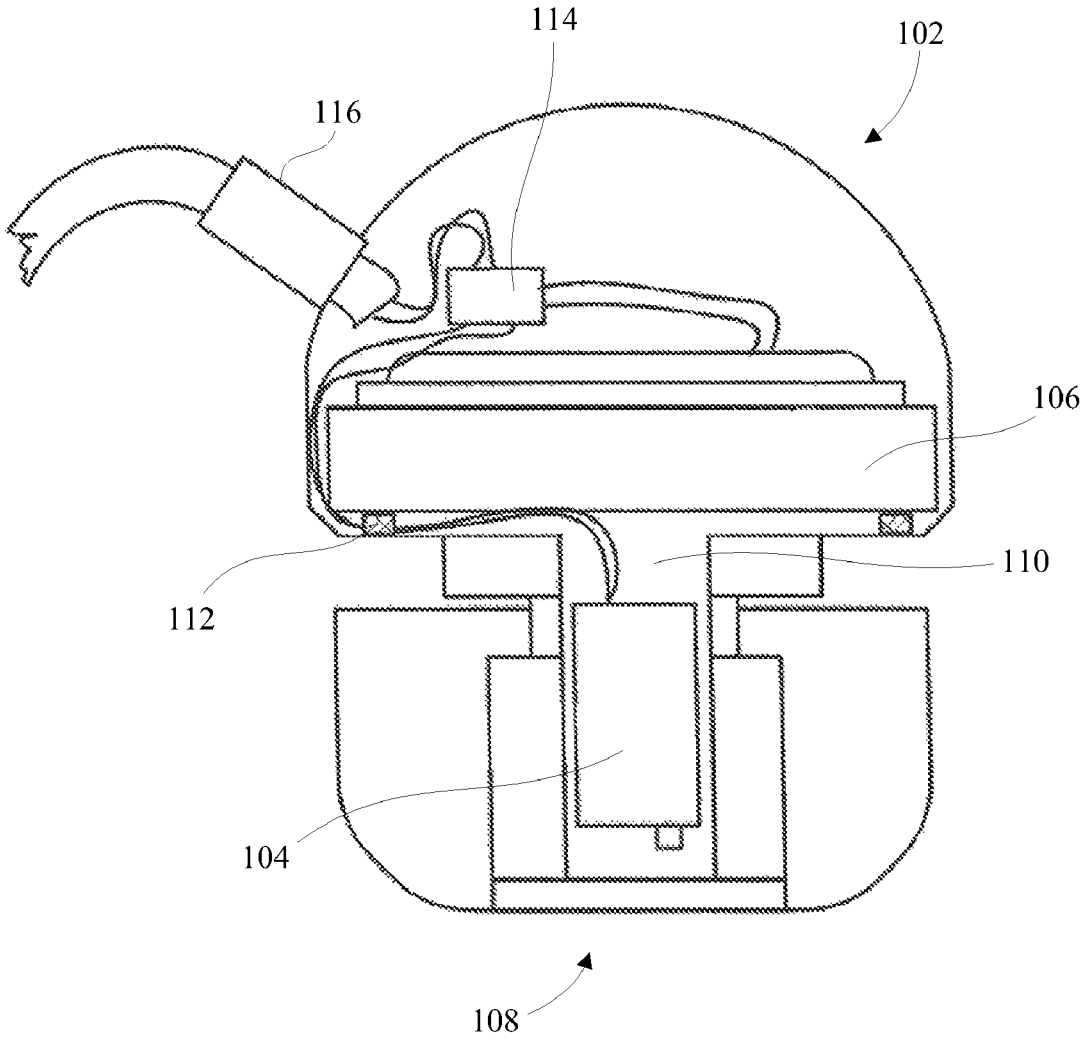
FIG. 1 illustrates a schematic cross-section of an earphone.

An earphone system converts electric signals into audible sound. FIG. 1 illustrates an in-ear earphone 102. The earphone 102 includes multiple electroacoustic transducers for converting electric signals into audible sound. The earphone 102 of FIG. 1 is described in U.S. patent application Ser. No. 12/402,101 and European Patent Application No. 08450034.7, which are assigned to the same Assignee as the present application and are hereby incorporated by reference. The earphone 102 includes a first transducer 104, a second transducer 106, and a sound opening 108 in the plug area of the earphone 102. The earphone 102 also includes a common sound channel 110 that is shared by both of the transducers 104 and 106. In the implementation of FIG. 1, the common sound channel 110 exists between the first transducer 104 and the second transducer 106 up to the sound opening 108. The earphone 102 includes a seal 112 along the periphery of the second transducer 106 to enclose the space around the transducers 104 and 106 to serve as the sound channel 110. The first transducer 104 lies within the sound channel 110. The earphone 102 may also include a frequency divider network 114 for supplying signals to the transducers 104 and 106. Electrical signals, power, or both may be sourced to the earphone 102 through a tangible media such as a cable and a lead-through 116. The arrangement of the earphone 102 may permit extreme miniaturization and therefore increased comfort for a wearer of the earphone 102.

Figure 2:
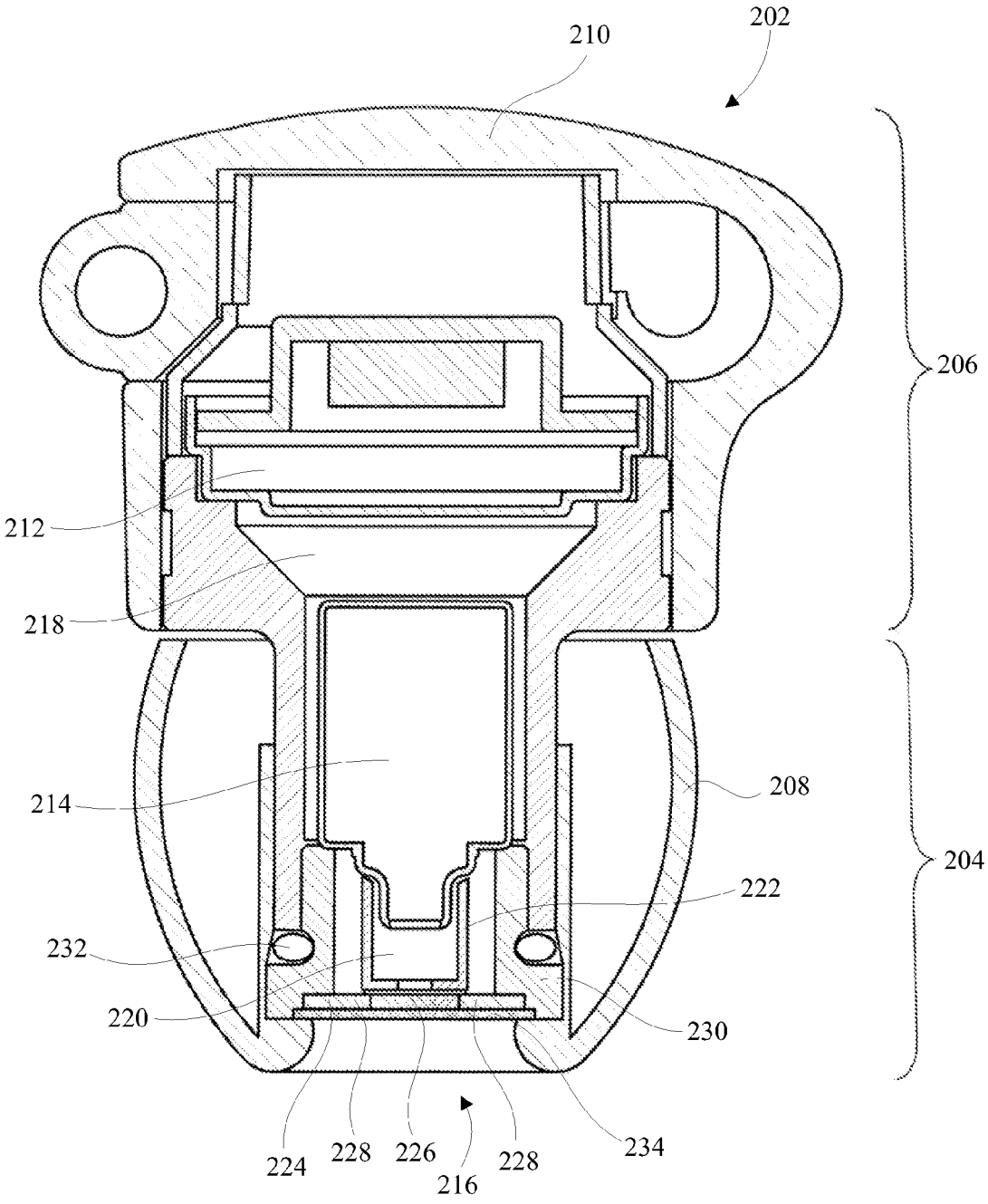
FIG. 2 illustrates a schematic cross-section of an alternative earphone.

FIG. 2 illustrates an alternative in-ear earphone 202. The earphone 202 of FIG. 2 includes a plug area 204 and an outer area 206. The plug area 204 may comprise the portion of the earphone 202 that is configured to sit in the auditory canal of a user when the earphone 202 is worn as intended. The outer area 206 may comprise the portion of the earphone 202 that lies outside the auditory canal. The outer surface of the plug area 204 may include or be defined by an ear cushion 208 and the outer surface of the outer area 206 may include or be defined by a housing 210.

The earphone 202 of FIG. 2 includes two electroacoustic transducers 212 and 214. In one implementation, the transducer 214 may be a balanced armature transducer ("BA transducer") while the transducer 212 may be a dynamic transducer. In this implementation, the transducer 214 may be situated within the sound channel of the transducer 212 in the plug area 204 of the earphone 202. In other implementations, other types of transducers or additional transducers may be used.

The transducers 212 and 214 receive electric signals and transmit acoustic waves through sound channels towards a sound opening 216 of the plug area 204. A housing 210 of the earphone 202 forms an open space to serve as a first sound channel 218. The first sound channel 218 is positioned to be adjacent to the transducer 212 so that the first sound channel 218 may carry the sound waves that are transmitted from the transducer 212 towards the sound opening 216. The earphone 202 also includes a second sound channel 220. The second sound channel 220 is positioned within the plug area 206 of the earphone 202. The second sound channel 220 is positioned to be adjacent to the transducer 214 so that the second sound channel 220 may carry the sound waves that are transmitted from the transducer 214 towards the sound opening 216. The transducer 214 and the sound channel 220 may be positioned inside the sound channel 218 in order to achieve a high degree of coincidence of sound transmission.

The earphone 202 includes a separating part, such as a barrier 222, to form the space of the sound channel 220. The barrier 222 may separate the sound channel 220 from other spaces within the earphone 202, such as the sound channel 218. The barrier 222 may be formed from a material that is capable of separating the sound channels 218 and 220 from each other acoustically. In some implementations, the barrier 222 may be formed from a material used in acoustics of transducers and earphones or plastic works, such as ABS, polyamide, rubber, or the like.

Because the barrier 222 may acoustically separate the sound channel 220 associated with the transducer 214 from the sound channel 218 associated with the transducer 212, at least one of the transducers 212 and 214 may be tuned separately from the other. For example, the separate sound channels 218 and 220 may be influenced separately. In one implementation, a user may tune only the transducer 212. In another implementation, a user may tune only the transducer 214. In yet another implementation, a user may tune each of the transducers 212 and 214 individually or together.

To achieve the desired tuning, the earphone 202 may include a filter disk 224 near the sound opening 216 of the plug area 204. The filter disk 224 may provide "acoustic friction" in the sound path of the transducers 212 and 214. The acoustic friction may be used to alter the transmission characteristics of sound waves that pass through the filter disk 224. In one implementation, acoustic friction may be used in the earphone 202 to adapt the sound transmission characteristics of the earphone 202 to the hearing habits, diseases, and/or preferences of the wearer. Filter disks with a variety of levels, types, or combinations of acoustic friction may be prepared. A user may then adjust the filter characteristics of the filter disk 224 by changing the type of filter disk used in the earphone 202. This permits the simple and rapid adjustment of the earphone 202 to the user and possibly compensation with tolerances of the transducers. The filtering provided by the filter disk 224 may be replaced as simply as possible and therefore also adapted as simply as possible in the earphone 202, without the multiple transducers of the earphone 202 adversely affecting each other.

The filter disk 224 may be partitioned or formed from multiple disk portions to provide separate acoustic filters to multiple abutting sound paths. The filter disk 224 may include a first filter portion 226 and a second filter portion 228 to provide acoustic friction to sound waves. In one implementation, the sound channel 218 terminates at the filter portion 228 and the sound channel 220 terminates at the filter portion 226. The barrier 222 may sufficiently separate the two sound channels 218 and 220 so that the sound waves from the transducer 212 pass through the filter portion 228 while the sound waves from the transducer 214 pass through the filter portion 226. In one implementation, the filter portion 226 may be selected to provide a different level or type of acoustic friction to the sound waves that pass through the filter portion 226 than the level or type of acoustic friction provided to the sound waves that pass through the filter portion 228. In another implementation, the filter portions 226 and 228 may be selected provide the same or similar level or type of acoustic friction. The level and type of acoustic friction may be customized independently for each of the filter portions 226 and 228 resulting in customized acoustic frictions for each of the sound channels 218 and 220 and respective transducers 212 and 214.

In the implementation of FIG. 2, the filter portion 226 has a circular cross-sectional area and represents the interior portion of the filter disk 224. The filter portion 226 lies in front of the sound path 220 so that the sound waves from the transducer 214 pass through the filter portion 226. In the implementation of FIG. 2, the filter portion 228 has a substantially annular cross-sectional area and represents the exterior portion of the filter disk 224. The filter portion 228 lies in front of the sound path 218 so that the sound waves from the transducer 212 pass through the filter portion 228. The sound channel 218 may have a substantially annular shape in the area of the transducer 214, and a substantially annular cross-section downstream of the transducer 214 where it encounters the filter portion 228 of the filter disk 224.

In one implementation, the barrier 222 may be formed into a substantially cylindrical shape. The term "cylindrical," such as when used in connection with the barrier 222, is not limited to circular-cylindrical or in any other way, it may cover all forms which are capable of separating an inner sound path from an outer sound path, which surrounds the inner sound path.

A first end portion of the barrier 222 may abut an outer surface of the transducer 214 and a second end portion of the barrier 222 may abut the filter disk 224. The barrier 222 abuts the transducer 214 at a location that results in the sound outlet of the transducer 214 being inside the sound channel 220 formed by the barrier 222. The barrier 222 may connect with the transducer 214 through slight elastic deformation in the vicinity of the sound outlet of the transducer 214 by friction fit. Alternatively, the barrier 222 and the transducer 214 may be connected through other connection methods, such as by glue or another fastener.

Figure 3:
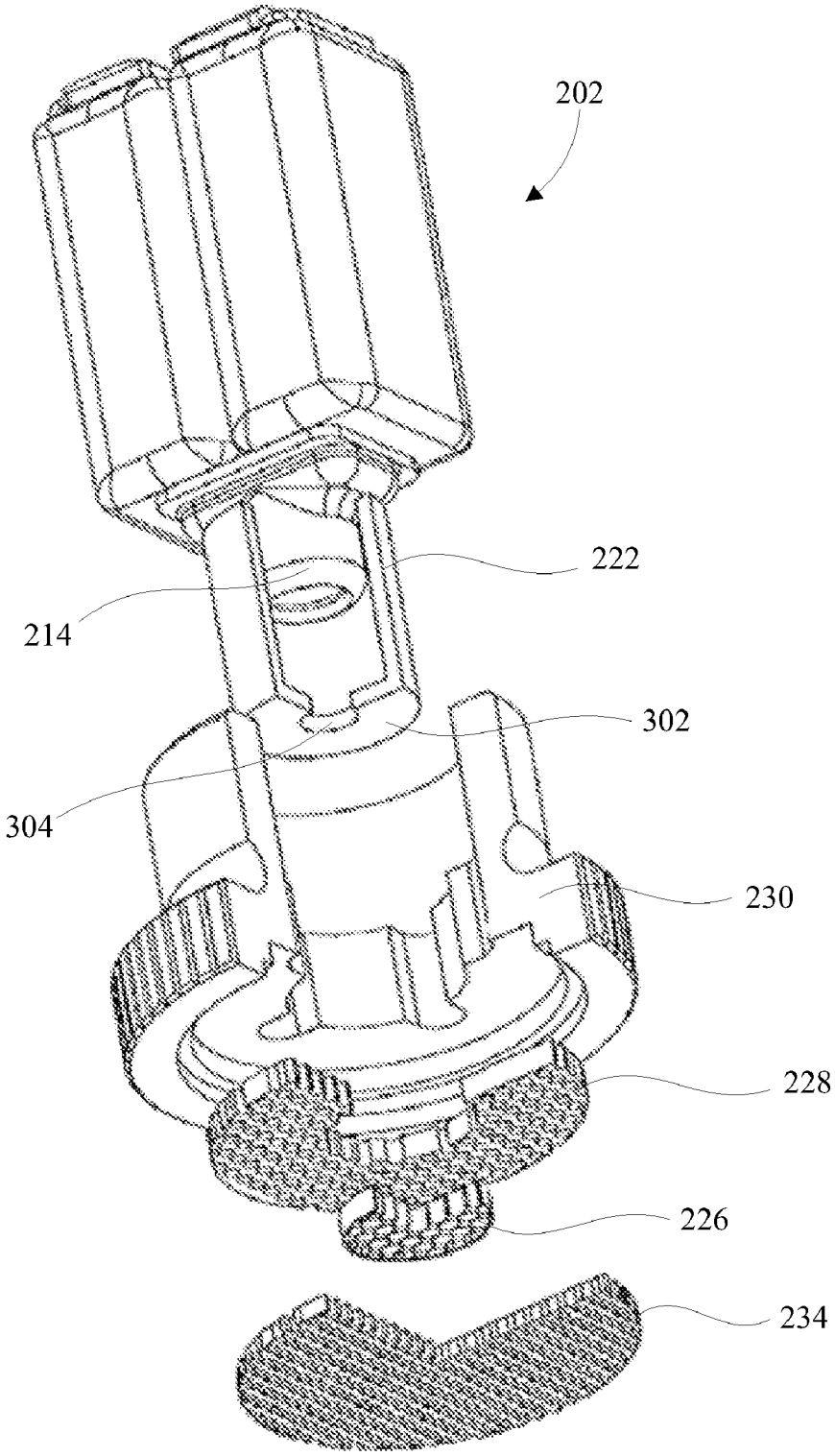
FIG. 3 illustrates a partial exploded view of the earphone of FIG. 2.

The barrier 222 abuts the filter disk 224 at a location so that the sound waves in the sound channel 220 will pass through the filter portion 226 and the sound waves in the sound channel 218 will pass through the filter portion 228. The barrier 222 may include a collar 302 (shown in FIG. 3) on the end directed toward filter disk 224. The collar 302 may abut against the filter disk 224. As shown in FIG. 3, the collar may extend inward while still leaving an opening 304 to allow passage of sound waves from the sound channel 220. The collar 302 may help provide separation between the two sound channels 218 and 220 by positioning the barrier 222 to substantially cover a boundary line between the filter portion 226 and the filter portion 228 when the collar 302 abuts against the filter disk 224. Other implementations may not use the collar 302, such as in situations where the wall thickness of the barrier 222 alone is large enough to cover the boundary line between the filter portion 226 and the filter portion 228. Alternatively, a support ring may be used to provide separation between the filter portion 226 and the filter portion 228.

The filter portions 226 and 228 of the filter disk 224 may be tuned individually for the user's preferences and the employed transducers and in all other conceivable circumstances and thus permit excellent acoustic adjustment of the in-ear earphone 202. In some implementations, the two filter portions 226 and 228 are directly adjacent to each other. In other implementations, the two filter portions 226 and 228 are separated from each other by an annular mount or the like.

In the implementation of FIG. 2, the filter disk 224 is coupled with a fastening part 230, such as through use of glue or another type of connection. The fastening part 230 may then be coupled with a matching part of the housing of the earphone 202, such as through a threaded screw connection or another type of connection. An O-ring 232 may be used to assist with corresponding mechanical and acoustic sealing.

The earphone 202 may also include a perforated plate 234 arranged outside of the filter disk 224 (e.g., on the side closest to the user's ear canal when the earphone 202 is being used). The perforated plate 234 may be friction fit, inserted, glued, or otherwise connected into the fastening part 230. The perforated plate 234 may reduce mechanical damage to the filter disk 224 by shielding the filter disk 224 from potential sources of damage. The perforated plate 234 may also represent a barrier to prevent earwax of the user from entering deeper into the earphone 202. The perforated plate 234 may reduce the possibility that characteristics of the filter disk 224 could be unintentionally altered due to damage or earwax buildup.

The earphone 202 of FIG. 2 may also include a frequency divider network similar to the frequency divider network 114 of FIG. 1. A frequency divider network in the earphone of FIG. 2 may be used to supply signals to the transducers 212 and 214. Electrical signals, power, or both may be sourced to the earphone 202 of FIG. 2 through a cable and a lead-through, similar to the cable and lead-through 116 shown in FIG. 1.

FIG. 3 illustrates a partial exploded view of the earphone 202 of FIG. 2. One possible design for an annular filter 228 and for the directly inserted or glued-in circular filter 226 is also shown in FIG. 3. Specifically, FIG. 3 shows an implementation of the filter disk 224 where the acoustic friction portion 226 comprises a perforated disk with a circular cross-section, and the acoustic friction portion 228 comprises a perforated disk with a substantially annular cross-section that is sized to fit around the outer diameter of the acoustic friction portion 226.

Figure 4:
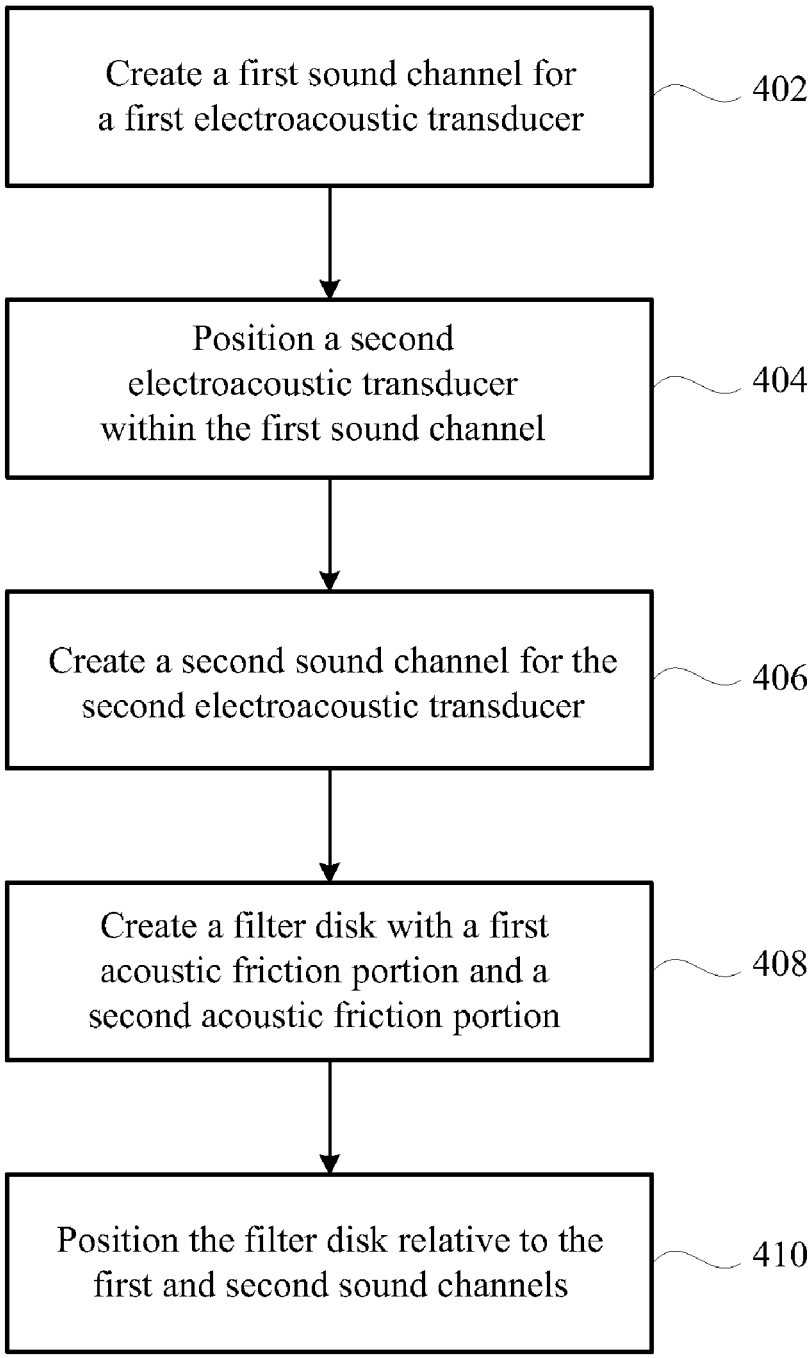
FIG. 4 illustrates a method of making the earphone of FIG. 2.

FIG. 4 illustrates a method of making the earphone 202. At act 402, the first sound channel 218 is created for the transducer 212. The sound channel 218 may be a path between the transducer 212 and the sound opening 216. At act 404, the transducer 214 is positioned within the first sound channel 218. At act 406, the second sound channel 220 is created for the transducer 214, such as by positioning the barrier 222 inside the first sound channel 218 to separate the space of the second sound channel 220 from the space of the first sound channel 218. The sound channel 220 may be a path between the transducer 214 and the sound opening 216. At act 408, the filter disk 224 is created to have multiple acoustic friction portions, such as the acoustic friction portion 226 and the acoustic friction portion 228. At act 410, the filter disk 224 is positioned relative to the sound channels 218 and 220. The filter disk 224 may be coupled with another portion of the earphone 202 in a position so that sounds traveling through the sound channel 218 pass through the acoustic friction portion 228 and sounds traveling through the sound channel 220 pass through the acoustic friction portion 226.

The components employed in the earphone 202 may be formed from materials used in acoustics of transducers and earphones and plastic works (e.g., ABS, polyamide, rubber, or the like), which are capable of separating the sound channels from each other acoustically, so that separate filtering for multiple sound channels may be possible. The same applies for filter disk 224 and the protective plate 234, which also may be designed to be replaceable by the user by a friction mount. The fastening part 230 may be formed from plastic (such as ABS, polyamide, rubber, or the like). In the implementation of FIG. 2, the ear cushion 208 protrudes beyond the edge of the filter disk 224, so that direct contact with the material of fastening part 230 may be reliably prevented. In some embodiments, it may also be possible to provide this part in its outer area with knurling or the like, in order to facilitate tightening or loosening of the housing of the earphone.

An acoustic tuning of the earphone 202 is made possible that is easily adapted to the corresponding user. The transducers of the earphone may have complete coincidence. The two sound paths of the earphone 202 may be bounded in cross-section by circles, and may be arranged concentrically to each other, so that the angle position of the disk-like acoustic filter plays no role in the area of the opening of the sound path. It may therefore be possible to screw the filter into the earphone like a screw or fasten it in some other way, without having to be concerned about its angle position. If damage occurs to the acoustic filter, the user desires tone color, the hearing capacity of the user changes, or the acoustic filter is soiled by earwax, then the user may easily replace the acoustic filter with a geometrically identical acoustic filter, if desired, with the same or different acoustic filter characteristics as the original acoustic filter.

Moreover, individual adjustments made by the user to the acoustic filter of the earphone 202 may allow the converter to no longer need to satisfy such strict specifications, standards, and tolerances as may have been previously used, since compensation for differences and deviations is readily possible cost-effectively by the simple adjustment of the acoustic filter characteristics. Therefore, the earphone 202 may permit an improvement in hearing and comfort, as well as being made at a reduced cost.

The disclosed earphone devices may be modified in different ways. The earphone may have at least two transducers, one of which is arranged in the sound path of the other so that the resulting sound path from the one transducer lies within the sound path of the other transducer. In one implementation, the sound paths are configured in a substantially concentric arrangement. The sound channels may have a substantially common center. Each of the sound paths may have their own acoustic friction, which makes tuning of each of the transducers possible. In implementations where the sound channels are substantially concentric, the multiple frictions may be designed to be substantially concentric. The multiple frictions may be arranged in a common component, in order to save space and ensure the small geometric dimensions that may be stipulated by the specific earphone application.

The cylindrical separating part (e.g., the barrier 222) between the two sound channels 218 and 220 may be designed either as its own part, as an integral part of the filter disk 224 or as an integral part of another portion of the in-ear earphone 202, such as an integral part of the transducer 214. Cylindrical may be understood to mean a general cylinder that in some implementations may not have a circular cross-section. Also, in some implementations, the barrier 222 may not have the same cross-section over the entire longitudinal extent. For example, in some implementations, the cross-section of the barrier 222 may be adjusted to the shape of the plug area 204.

The term "filter disk" does not limit the shape of this part, which may have a substantially different shape, such as when the filter disk includes the barrier 222 as an integral portion of the filter disk 224. Even if the barrier 222 is separate from the filter disk 224, the filter disk 224 may have the shape of a drum, a tube, a pipe, or any other shape depending on the shape of the plug area 204 and the shape of the acoustic friction portions used in the filter disk 224.

Earphones may assume a wide variety of shapes and sizes. The shape and size of an earphone overall and the individual parts of the earphone may depend on the application and/or the design. The earphones of FIGS. 1-3 are shown to include two transducers. However, in other implementations, the earphones of FIGS. 1-3 may include more than two transducers. Additionally, the use of the terms plug area and outer area serves only for easier location of the components within the earphone, so that no additional reference to the wearer or the auditory canal of the wearer is necessary.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. An in-ear earphone, comprising:

a plug area with at least one sound opening;

a first electroacoustic transducer;

a second electroacoustic transducer positioned within the plug area and within a first sound path of the first transducer;

a separating part positioned between the second transducer and the sound opening, where the separating part forms a barrier between the first sound path for the first transducer and a second sound path for the second transducer, and where the first sound path comprises a substantially annular cross-section disposed around the second sound path; and a filter disk arranged in the sound opening, in which an acoustic friction is provided for each of the first and second sound paths.

2. The earphone of claim 1, where the filter disk has a circular cross-section, and the first and second sound paths are arranged concentrically to each other in an area of the filter disk.

3. The earphone of claim 1, further comprising a perforated plate adjacent to the filter disk, where the perforated plate mechanically supports the filter disk and shields the filter disk from penetration of earwax.

4. The earphone of claim 1, where the separating part comprises a collar formed on an end of the separating part, and where the collar abuts the filter disk.

5. The earphone of claim 1, where the separating part abuts the filter disk and at least partially covers a boundary between a first acoustic friction portion of the filter disk and a second acoustic friction portion of the filter disk.

6. The earphone of claim 1, further comprising a fastening part, where the filter disk is mounted in the fastening part.

7. The earphone of claim 6, further comprising an earphone housing, where the fastening part comprises a threaded portion screwed onto the earphone housing.

8. The earphone of claim 1, where the filter disk comprises a first acoustic friction portion and a second acoustic friction portion, where the first acoustic friction portion is positioned to receive sound waves from the first transducer through the first sound path on a first side of the separating part, and where the second acoustic friction portion is positioned to receive sound waves from the second transducer through the second sound path on a second side of the separating part.

9. The earphone of claim 1, where the separating part has a cylindrical shape and is friction fit to the second transducer at a position where a sound outlet of the second transducer is located inside the cylindrical shape of the separating part.

10. An earphone device that converts electric signals to audible sound, comprising:

a first electroacoustic transducer;

a housing that forms a first sound channel adjacent to the first transducer;

a second electroacoustic transducer positioned within the first sound channel;

a barrier that forms a second sound channel adjacent to the second transducer and within the first sound channel; and a filter disk that comprises a first acoustic friction portion and a second acoustic friction portion, where the first acoustic friction portion is positioned to receive sound waves from the first transducer through the first sound channel on a first side of the barrier, and where the second acoustic friction portion is positioned to receive sound waves from the second transducer through the second sound channel on a second side of the barrier.

11. The earphone of claim 10, further comprising a plug area configured to fit within a user's auditory canal, where the second transducer is at least partially positioned within the plug area.

12. The earphone of claim 10, where a first portion of the barrier abuts the second transducer, and where a second portion of the barrier abuts the filter disk and at least partially covers a boundary between the first acoustic friction portion and the second acoustic friction portion.

13. The earphone of claim 10, where one of the first and second transducers is a balanced armature transducer, and where another of the first and second transducers is a dynamic transducer.

14. The earphone of claim 10, where the filter disk has a circular cross-section, and the first and second sound channels are arranged concentrically to each other in an area of the filter disk.

15. The earphone of claim 10, where the first acoustic friction portion has a substantially annular cross-section and is disposed around an outside surface of the second acoustic friction portion, and where the first sound channel has a substantially annular cross-section disposed around the second sound channel.

16. The earphone of claim 15, where the first acoustic friction portion and the second acoustic friction portion are arranged concentrically to each other.

17. The earphone of claim 10, where the barrier is formed from a material that acoustically separates the first sound channel from the second sound channel.

18. The earphone of claim 10, where the barrier has a cylindrical shape and is friction fit to the second transducer at a position where a sound outlet of the second transducer is located inside the cylindrical shape of the barrier.

19. The earphone of claim 10, where the first acoustic friction portion provides a different level or type of acoustic friction than the second acoustic friction portion.

20. An earphone device that generates audible sound, comprising:

a filter disk;

a plurality of electroacoustic transducers;

a housing that forms a first sound channel adjacent to a first transducer of the plurality of electroacoustic transducers, where the first sound channel terminates at a first acoustic friction portion of the filter disk; and a barrier within the first sound channel that abuts the filter disk and a second transducer of the plurality of electroacoustic transducers, where the barrier forms a second sound channel adjacent to the second transducer that terminates at a second acoustic friction portion of the filter disk, and where at least a portion of the first sound channel comprises a substantially annular cross-section disposed around the second sound channel.

* * * * *